US005547707A

United States Patent [19]

Haubert et al.

[11] Patent Number: 5,547,707

[45] Date of Patent: Aug. 20, 1996

[54] METHOD AND APPARATUS FOR APPLYING GRANULES TO STRIP ASPHALTIC ROOFING MATERIAL TO FORM VARIEGATED SHINGLES

[75] Inventors: Thomas D. Haubert, Columbus; James S. Belt, Utica, both of Ohio

[73] Assignee: Owens Corning Fiberglas Technology, Inc., Summit, Ill.

[21] Appl. No.: 487,947

[22] Filed: Jun. 7, 1995

[51] Int. Cl.[6] ..... B05D 1/30

[52] U.S. Cl. ..... 427/188; 427/420

[58] Field of Search ..... 427/186–188, 427/420; 118/308

[56] References Cited

U.S. PATENT DOCUMENTS

| | | | |
|---|---|---|---|
| 1,379,368 | 5/1921 | Speer | 427/188 |
| 2,111,761 | 3/1938 | Eckert | 427/188 |
| 2,302,183 | 11/1942 | Burns | 427/188 |
| 2,905,569 | 9/1959 | Zitke | 427/188 |
| 4,647,471 | 3/1987 | Jenkins | 427/420 |
| 5,283,080 | 2/1995 | Lamb et al. | 427/8 |
| 5,405,647 | 4/1995 | Grubka et al. | 427/188 |

*Primary Examiner*—Shrive Beck
*Assistant Examiner*—Fred J. Parker
*Attorney, Agent, or Firm*—C. Michael Gegenheimer; Inger H. Eckert

[57] ABSTRACT

A method and apparatus for applying granules to a coated asphalt sheet to form at high production speeds a variegated pattern having uniform edges between areas of different colored granules. Granules of a first color or color blend are applied to spaced first areas on a moving, tacky, asphaltic strip by dropping the granules onto the moving strip. The leading and/or trailing edges of each granule drop are trimmed off by cutting or deflecting to provide predetermined sharp leading and/or trailing edges to the first areas. Granules of a second color or color blend are then deposited on the strip by dropping on tacky second areas between the spaced first areas. If desired, one or both edges of the second color granule drops also may be trimmed, the second color granules may be deposited on only a portion of the tacky strip areas between the spaced first areas, and additional color granules may be applied to the remaining tacky areas to form shingles with three or more colored areas.

17 Claims, 5 Drawing Sheets

METHOD AND APPARATUS FOR APPLYING GRANULES TO STRIP ASPHALTIC ROOFING MATERIAL TO FORM VARIEGATED SHINGLES

TECHNICAL FIELD

The invention pertains to the handling of continuous strips of asphaltic material, such as asphaltic material suitable for use as roofing membranes and roofing shingles. In one of its more specific aspects, the invention relates to controlling the application of granules to asphaltic strip material to form a variegated surface pattern.

BACKGROUND

A common method for the manufacture of asphalt shingles is the production of a continuous strip of asphaltic shingle material followed by a shingle cutting operation which cuts the strip into individual shingles. In the production of asphaltic strip material, either an organic felt mat or a glass fiber mat is passed through a coater containing hot liquid asphalt to form a tacky coated asphaltic strip. Subsequently, the hot asphaltic strip is passed beneath one or more granule applicators which apply protective surface granules to portions of the asphaltic strip material. Typically, the granules are dispensed from a hopper at a rate which can be controlled by making manual adjustments on the hopper.

Not all of the granules applied to the hot, tacky, coated asphaltic strip adhere to the strip. Typically, the strip material is turned around a slate drum to press the granules into the tacky asphalt and to invert the strip. The non-adhered granules then drop off the strip. These non-adhered granules, which are known as backfall granules, are usually collected in a backfall hopper for recycling.

In the manufacture of colored shingles, two types of granules may be employed. Headlap granules are granules of relatively low cost used for portions of the shingle which are to be covered up. Colored granules or prime granules are of relatively higher cost and are applied to the portion of the shingle which will be exposed on the roof.

To provide a color pattern of pleasing appearance, the colored portion of the shingles may be variegated or provided with areas in different colors. Usually the shingles have areas of background color granules separated by highlighted areas of granule deposits of different colors or different shades of the background color. The highlighted areas, referred to as blend drops, are typically made from a series of granule containers applied by means of feed rolls. The length and spacing of each area on the sheet is dependent on the speed of the feed roll, the relative speed of the sheet and the length of time during which the drop is made. A programmable controller controls the speed of the sheet and the times of the blend drops.

A common method for manufacturing a variegated shingle involves applying granules of a first color or blend drops to spaced first areas on the moving hot, tacky asphaltic strip. Granules of a second or background color are then applied to the areas between the first area blend drops. However, imperfections in feeding the first granules creates irregular leading and trailing edges for the first area blend drops. At high production speeds, the effects of the granule feeding imperfections are accentuated. Typically, the granules will be deposited sooner in the center region of the moving strip than at the outer sides of the leading edge of each first area. The granule deposition also will tend to terminate later in the center region of the moving strip than at the outer sides. This can result in an oval shape for each first area which becomes more accentuated as production speeds increase. Further, granule feeding imperfections can cause the density of the granules at the leading and trailing edges of each first area to be lower than in the center of the area. Difficulties in feeding the first color granules have prevented using this method for manufacturing high-quality variegated shingles at high production speeds.

One well-known prior-art technique for manufacturing variegated shingles involved the application of the background color granules over the entire exposed tacky surfaces of the shingles. Adhesive such as hot asphalt is applied to the background color granules on the sheet in the areas where the blend drops are to be applied—and then the blend drops are applied and stick only to the tacky areas. The double layers of granules in the blend drop areas make these shingles relatively expensive, heavy and inflexible.

One of the problems with typical granule application equipment is that the feeder rolls depend on mechanical movement (rotation) to index to the next position to enable another blend drop to fall onto the moving coated asphalt sheet. Usually the granules are discharged from a hopper onto a fluted roll from which, upon rotation, the granules are discharged onto the coated asphaltic sheet. The roll is ordinarily driven by a drive motor, and the roll is positioned in the drive or non-drive position by means of a brake-clutch mechanism. The requirement for mechanical action has inherent limitations which prevent a very precise beginning and ending to the blend drop. Also, once the mechanical action takes place, there is a short time lag as gravity takes effect on the granules. Consequently, there is a limit to the sharpness of the blend drops on the shingle. As shingle manufacturing lines go up in speed, the lack of sharpness is accentuated and the distinction between the blend drop and the background color becomes fuzzy. The lack of sharpness puts a severe limitation on the kinds of designs and color contrasts which can be applied to shingles at high production speeds.

Another cause of the impreciseness of typical granule-depositing techniques is that the feeders typically depend on gravity exclusively, not only for directing the granules from the hopper to the moving coated asphalt sheet, but also for movement of the granules within the hopper itself. The use of gravity to move the granules within the hopper or discharge apparatus itself has granule feed rate limitations. There has been no easy way to control the rate of flow of the granules for the entire blend drop.

A recently developed improved method for depositing granules onto the moving coated asphalt sheet uses a pneumatic control to provide a relatively high degree of preciseness in depositing the granules. The newly developed method provides relatively instantaneous control of the flow of granules. The flow of granules is started, stopped and controlled by providing pneumatic pressure changes in a buffer chamber positioned adjacent an accumulation of granules in a granule nozzle. It has been found, however, that although the pneumatically controlled granule blend drop apparatus provides a very sharp leading edge for a blend drop, it produces a fuzzy or less sharp trailing edge for the blend drop. An improved process would provide for manufacturing variegated shingles at high speeds in which the blend drops have both a sharp leading edge and a sharp trailing edge.

DISCLOSURE OF INVENTION

According to the invention, an improved method and apparatus have been developed for manufacturing variegated shingles at high production speeds. A continuous moving tacky strip of asphaltic sheet material is formed by passing an organic felt mat or a glass fiber mat through a coater containing hot liquid asphalt. While the asphalt remains tacky, blend drops of first colored granules are periodically dispensed onto the moving strip to form spaced first granule coated areas. The blend drops will have irregular leading and/or trailing edges. According to the invention, the irregular leading and/or trailing edges of the blend drops are cut off or trimmed as the blend drops fall from a dispensing hopper to the strip to provide more uniform, well-defined leading and trailing edges to the first granule coated areas on the moving strip. The asphalt on the strip between the first areas defines tacky second areas. Background or second colored granules are then dispensed onto the tacky second areas. Any of the second colored granules falling on the first areas will not adhere to the strip, since the tacky surface in each first area is already covered with first color granules. The second granules can be of a single color or of a color blend. To achieve a desired appearance, more than one blend drop may be used, and frequently three or more blend drops are used. The granule coated strip is passed over a slate drum to press the granules into the strip and to invert the strip. All non-adhering backfall granules are collected in a hopper for recycling when the strip is inverted. The blend drops applied to the first areas or to other areas may include the backfall granules. After the backfall granules are removed, the moving strip is cooled and cut into individual shingles.

The method for manufacturing variegated shingles has an advantage in that it is not limited by the ability of the equipment and the effects of gravity to dispense blend drops with uniform leading and trailing edges at high production speeds. Further, the variegated shingles produced according to the invention do not have areas of multiple thicknesses of granules. Consequently, the shingles are less expensive to manufacture, lighter in weight and more flexible than shingles in which the blend drops are applied over the primary color granules.

Accordingly, it is an object of the invention to provide a method and apparatus for manufacturing variegated shingles at high production speeds with uniform edges between the different colored granule areas.

Other objects and advantages of the invention will be apparent from the following description and the accompanying drawings.

BEST MODE FOR CARRYING OUT THE INVENTION

The invention will be described with reference to an assembly for manufacturing variegated aspbaltic roofing material having granules bonded to a surface. The surface of the illustrated roofing material has alternating areas containing granules of a base or background color and of a blend drop separated by sharp edges to form a pleasing appearance. It is to be understood, however, that the invention can apply equally to the manufacture of other types of roofing materials. For example, the invention is applicable for applying a greater number of granule colors to different areas of the roofing material. There may be a base or background color and a number of blend drops. Further, the base color may be a solid color or a color blend. Also, it will be appreciated that the term "variegated" may include both multiple discrete color areas and color areas which blend together through some mixing of the granules at the sharp color transition borders.

For the purposes of this invention, a "sharp" edge or border means that substantially all (at least 90% and, preferably, at least 95%) of the boundary between one color and another lies within about 0.4 inch (1.0 cm) of a straight line drawn along the boundary. For a typical roof shingle, the boundary will be about 13 cm long. The term "fuzzy" means that the boundary is not sharply defined, and that the granules of one color overlap a substantial distance into the area of granules of another color. Generally, a fuzzy edge is an edge that is not a sharp edge.

Figure 1:
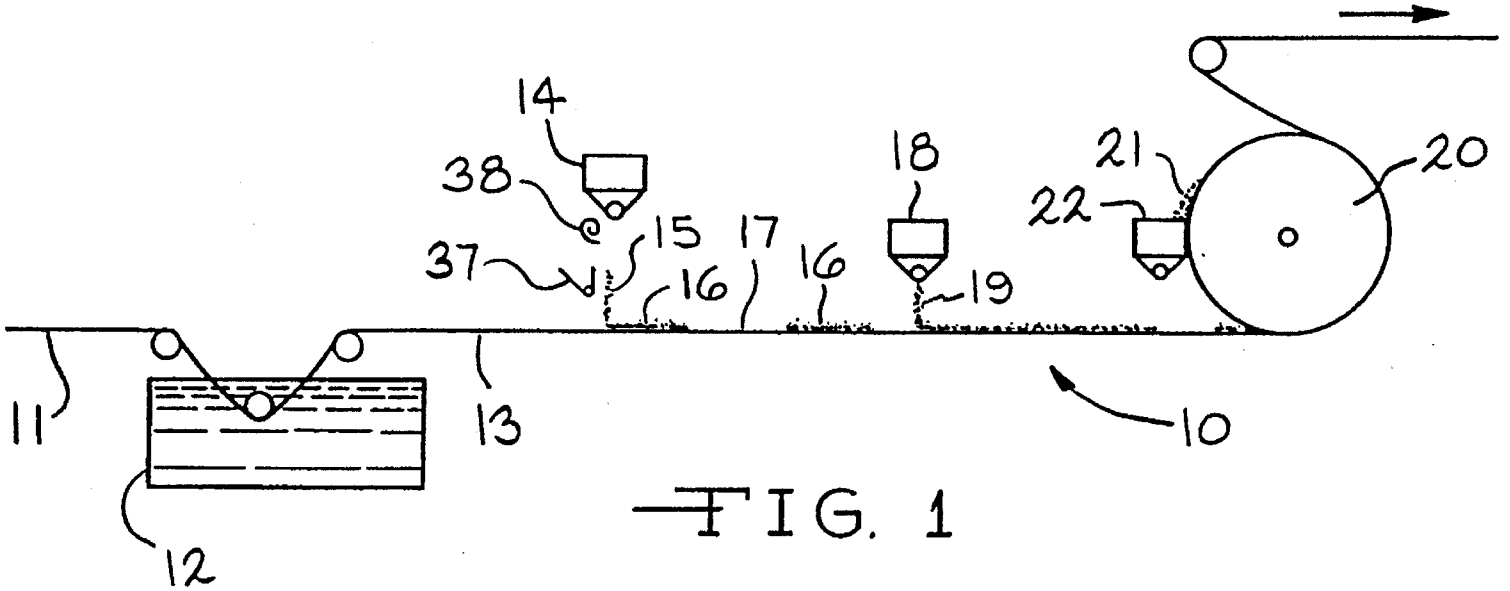
FIG. 1 is schematic cross-sectional elevational view of apparatus for manufacturing granule-covered roofing material according to the principles of the invention.

Referring to FIG. 1 of the drawings, a portion of apparatus 10 for manufacturing variegated roofing shingles is shown according to a preferred embodiment of the invention. A sheet or web 11 of an organic felt mat or a glass fiber mat is passed through a coater 12 containing hot, liquid asphaltic material (including filler) to create a continuous hot, tacky strip or sheet 13 of asphaltic material. The tacky strip 13 then passes beneath a granule hopper 14 which periodically discharges granules 15 of a first color onto the strip 13. The granules 15 are deposited to form spaced first areas 16 which are separated by still tacky second surface areas 17 on the strip 13. From the hopper 14, the strip 13 is moved past a second hopper 18 which deposits granules 19 of a second color onto the second areas 17. Because of the imperfections of the granule feeding from the hopper 18, it is necessary to have the leading and trailing edges of the second granule drop overlap the granules 15 in the first areas 16. However, the second granules 19 which fall onto the first areas will not stick to the strip 13, since the first areas 16 on the strip 13 are already coated with the first granules 15 and are no longer tacky.

After deposition of the second granules 19 at the hopper 18, the granule-coated strip 13 passes over a slate drum 20 which presses the granules 15 and 19 into the tacky strip 13 and inverts the strip 13 sufficiently for any non-adhering backfall granules 21 to fall into a hopper 22 for recycling. From the drum 20, the strip 13 passes through a conventional cooling section (not shown) and a cutter (not shown) which cuts the strip 13 into the finished shingles. The backfall granules 21 collected in the hopper 22 will consist of a mixture of the first granules 15 and the second granules 19. Preferably, the second granules 19 will be of the background color and the first granules 15 will be a blend drop consisting of a mixture of the backfall granules 21 and granules of one or more colors selected to create a pleasing appearance to the finished shingles. If, for example, it is desired to manufacture shingles having three different colored areas, two or more blend drops may be applied to the strip 13 in addition to the background granules. The backfall granules 21 may be used with any of the blend drops.

Figure 3:
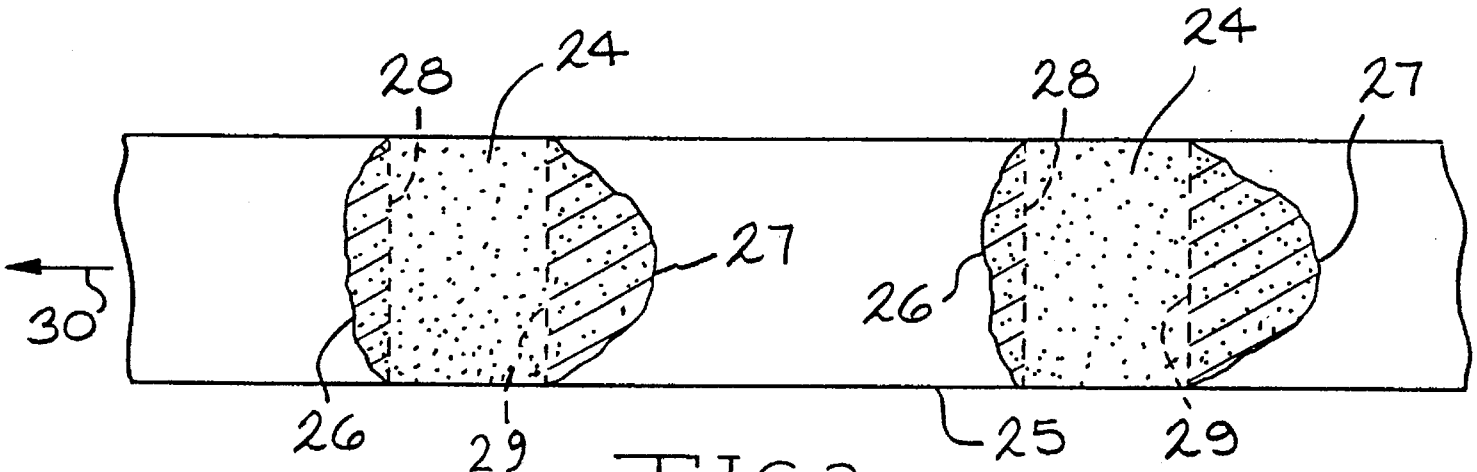
FIG. 3 is a plan view showing the shape of a typical blend drop as dispensed by the hopper of FIG. 2.
Figure 2:
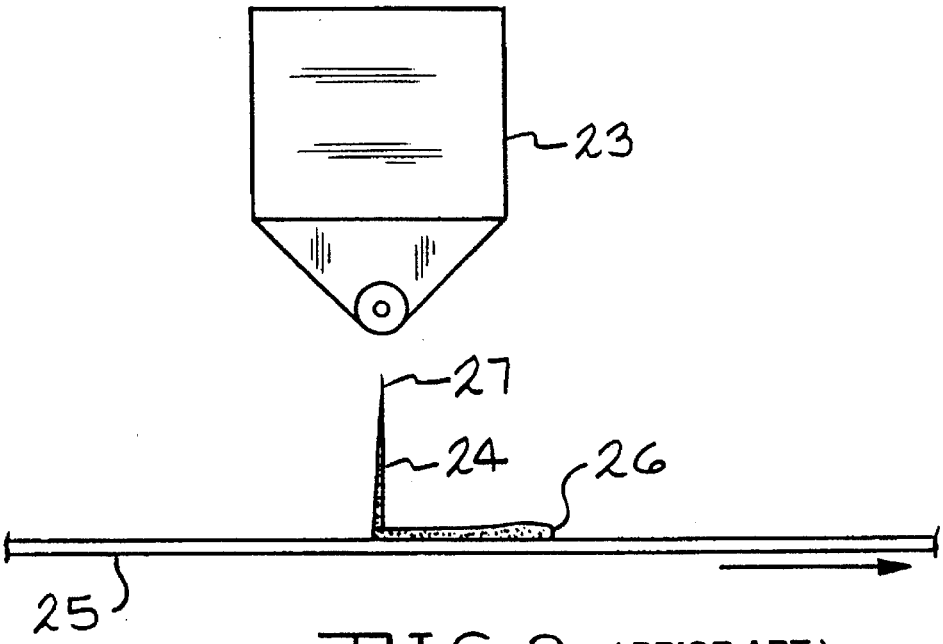
FIG. 2 (PRIOR ART)
FIG. 2 is an enlarged side elevational view showing a conventional prior art hopper dispensing a blend drop onto a moving sheet of tacky aspbaltic material.

FIG. 2 illustrates a prior art granule hopper 23 from which a blend drop 24 is discharged to fall through the action of gravity onto a moving tacky strip 25, and FIG. 3 shows an exemplary plan view of two blend drops 24 as collected on an asphaltic strip 25. The blend drop 24 has an irregular leading edge 26 and an irregular trailing edge 27. Due to recent advances in the blend drop feeding apparatus, the leading edge 26 may be more straight than the trailing edge 27, and the leading edge 26 may be sufficiently sharp to be acceptable. Ideally, the blend drop 24 will have sharp leading and trailing edges 28 and 29 (shown in dashed lines) which extend perpendicular to a direction 30 of movement of the blend drop 24 and of the moving strip 25. As the speed of the moving strip 25 increases for higher production speeds, the distortion of the leading and trailing edges 26 and 27 from the desired sharp edges 28 and 29 will increase. According to the present invention, the leading edge 26 of the blend drop 24 is trimmed to obtain the sharp leading edge 28, and/or the trailing edge 27 of the blend drop 24 is trimmed to obtain the sharp trailing edge 29.

Figure 4:
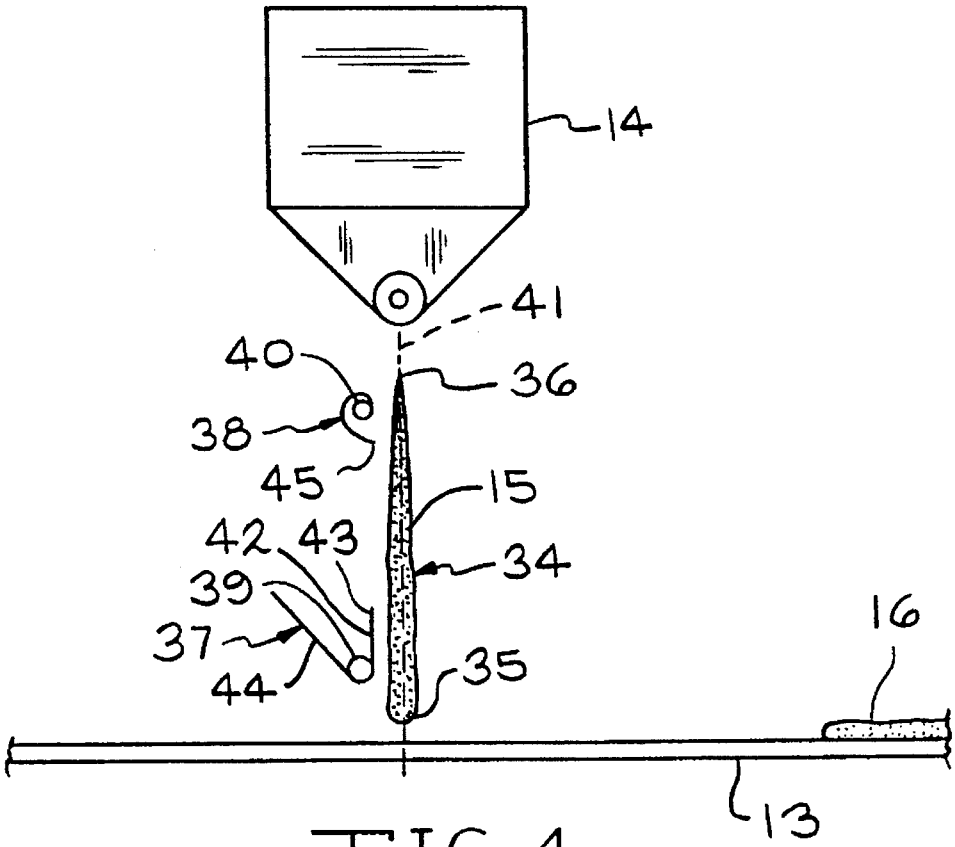
FIG. 4 is an enlarged side elevational view showing a hopper for dispensing a blend drop with apparatus according to one embodiment of the invention for trimming the leading and trailing edges of the blend drop as it falls onto a moving sheet of tacky asphaltic material.

As shown in FIGS. 1 and 4, the hopper 14 is periodically operated to deposit a blend drop 34 of the first color granules 15 on the tacky strip 13 to form spaced first granule covered areas 16 separated by tacky second areas 17. According to the invention, leading edge 35 and/or trailing edge 36 of each blend drop 34 are trimmed to provide a uniform rectangular configuration to the deposited blend drop 34 with sharp leading and trailing edges. Although apparatus is illustrated for trimming both the leading edge 35 and the trailing edge 36 of each blend drop 34, it will be appreciated that, depending on the capabilities of the hopper 14, it may be necessary to trim only the trailing edge 36 or only the leading edge 35.

As is illustrated, a lower catcher 37 is provided for trimming the leading edge 35 of the blend drop 34 and an upper catcher 38 is provided for trimming the trailing edge 36. The lower catcher 37 is mounted to rotate on a pivot 39, and the upper catcher 38 is mounted to rotate on a pivot 40. Suitable electronic controls (not shown) are provided for pivoting the lower catcher 37 in synchronism with each falling blend drop 34 for trimming the leading edge 35 and for pivoting the upper catcher 38 in synchronism with each falling blend drop 34 for trimming the trailing edge 36. Although the lower and upper catchers 37 and 38 are illustrated with a substantial vertical spacing, it should be appreciated that they may be spaced closely together.

The blend drop 34 travels along a path 41 as it falls from the hopper 14 to the moving tacky strip 13. The lower catcher 37 has a plate 42 secured to the pivot 39 having a sharp edge 43 which passes through the path 41 as the lower catcher 37 is pivoted in a clockwise direction. It will be appreciated that the blend drop 34 as illustrated has a depth perpendicular to the drawing sheet which is equal to the desired width of the first areas 16. The lower catcher plate 42 will have a depth at least as great as the depth of the blend drop 34 to trim the leading edge 35 over its entire width. The lower catcher 37 has a second plate 44 which extends at an angle to the plate 42. When the leading edge 35 is trimmed from the blend drop 34, the trimmed granules 15 fall between the plates 42 and 44 and are returned by a conveyor (not shown) back to the hopper 14 for recycling.

The upper catcher 38 is illustrated as having a generally spiral configuration with an open edge 45 which extends over at least the entire depth of the blend drop 34. As the upper catcher 38 is pivoted in a counter-clockwise direction, the edge 45 passes through the blend drop path 41 to cut a sharp trailing edge to the blend drop 34.

Figures 5, 6, 7, 8, 9, 10:
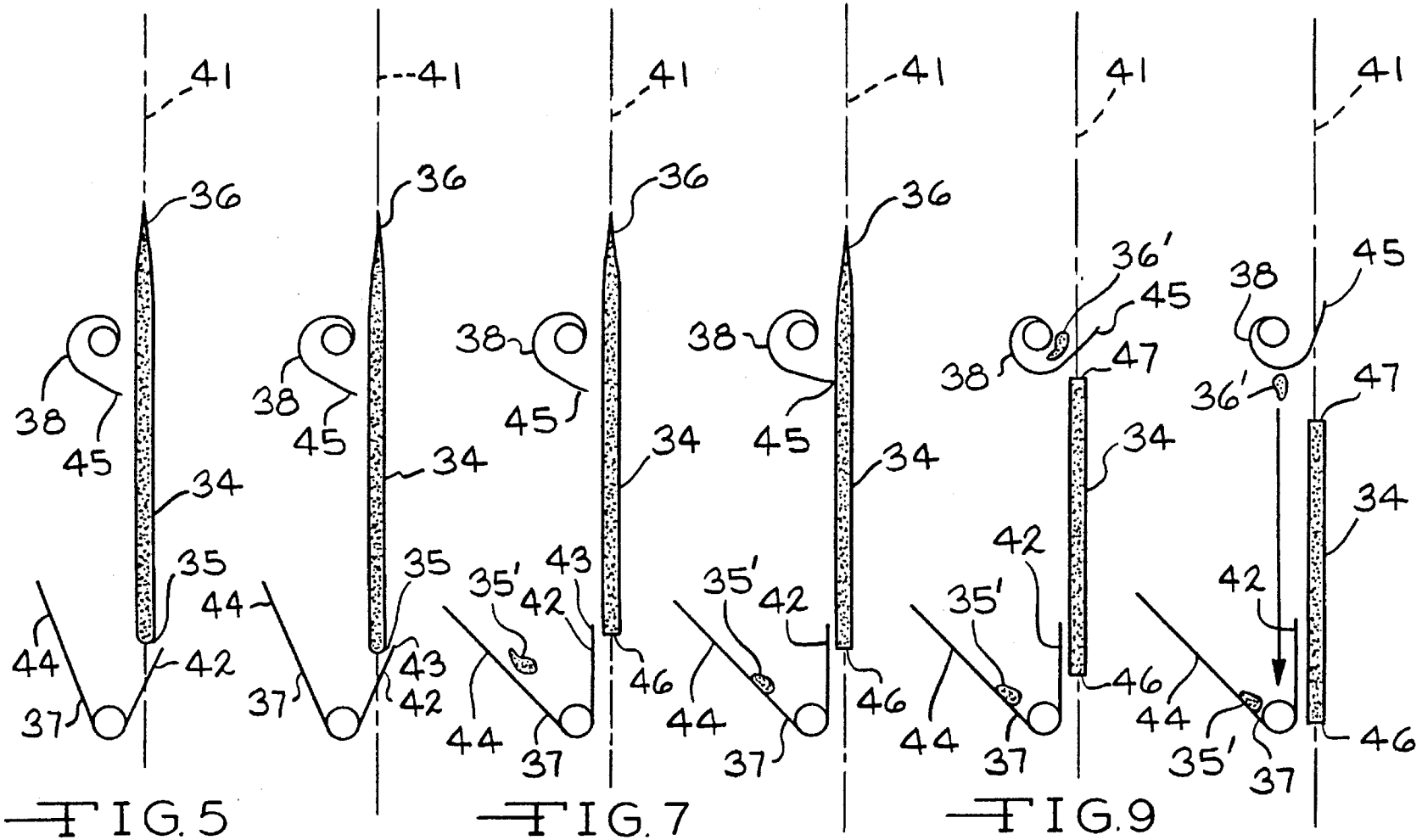
FIG. 5 is a diagrammatic side elevational view illustrating the blend drop trimmers with the lower trimmer positioned to interfere with a falling blend drop.
FIG. 6 is a diagrammatic side elevational view, similar to FIG. 5, and showing the blend drop entering the lower trimmer.
FIG. 7 is a diagrammatic side elevational view, similar to FIG. 5, and showing the lower trimmer moved to trim the leading edge of the blend drop.
FIG. 8 is a diagrammatic side elevational view, similar to FIG. 5, and showing the upper trimmer being moved to a position for cutting off the trailing edge of the blend drop.
FIG. 9 is a diagrammatic side elevational view, similar to FIG. 5, and showing the trailing edge of the blend drop cut off by the upper trimmer.
FIG. 10 is a diagrammatic side elevational view, similar to FIG. 5, and showing the upper trimmer moved to a position wherein the trimmings from the trailing edge of the blend drop are released to fall into the lower trimmer.

FIGS. 4 through 10 illustrate operation of the catchers 37 and 38 for trimming the leading and trailing edges 35 and 36, respectively, of the blend drop 34 as it falls toward the moving strip 13. When the hopper 14 begins to deliver a blend drop 34, the lower catcher 37 is rotated in a clockwise direction until the plate 42 intercepts the blend drop path 41, as shown in FIG. 5. The lower catcher 37 remains in this position until the leading edge 35 of the falling blend drop 34 is below the edge 43 of the lower catcher plate 42, as shown in FIG. 6. At the appropriate time, the lower catcher 37 is rapidly rotated in a counter-clockwise direction until the plate 42 is clear of the path 41, as shown in FIG. 7. As the lower catcher 37 is rotated, the leading edge 35 of the blend drop 34 is cut off or trimmed by the plate edge 43, leaving a sharp leading edge 46. Trimmed leading edge granules 35' are caught between the plates 42 and 44 and are returned to the hopper 14 (FIG. 4) for recycling.

It should be appreciated that the strip 13 in FIG. 4 is moving from left to right and that the lower catcher 37 is rotated in a counter-clockwise direction as the leading edge 35 is trimmed. Consequently, any granules 15 which may be sprayed or knocked from the trimmed leading edge 46 which miss collection in the lower catcher 37 will be to the left of the falling blend drop 34. If these granules 15 should fall onto the moving strip 13, they will fall onto the first area 16 behind the trimmed leading edge 46 along with the blend drop 34.

While the leading edge 35 was trimmed, the upper catcher 38 was positioned clear of the path 41, as shown in FIGS. 5 through 7. At the appropriate time, the upper catcher 38 begins rotation in a counter-clockwise direction, and the edge 45 moves toward the path 41, as shown in FIG. 8. The upper catcher 38 is rotated further so that the edge 45 passes through the path 41, cutting off or trimming the trailing edge 36 from the falling blend drop 34, as shown in FIG. 9. This produces a sharp trailing edge 47 on the falling blend drop 34. The trimmings 36' are initially caught in the upper catcher 38 as it rotates. The trimmings 36' may be conveyed from the upper catcher 38 to the hopper 14 for recycling. Or, as the upper catcher 38 is rotated, the trailing edge trimmings 36' may fall through an opening in the catcher 38 and into the lower catcher 37 for recycling with the lower catcher trimmings 35', as shown in FIG. 10. After trimming the trailing edge 36, the upper catcher 38 is returned to its initial position clear of the path 41.

As indicated above, the upper catcher 38 is rotated in a counter-clockwise direction when the trailing edge 36 is trimmed. Thus, the upper catcher edge 45 moves from left to right, and any sprayed granules 15 will be diverted to the right of the falling blend drop 34. Consequently, any such sprayed granules 15 will end up in the first areas 16 in front of the trimmed trailing edge 47.

FIGS. 11 through 18 illustrate a modified embodiment of the invention in which a deflector 48 is used to trim the leading and trailing edges 35 and 36 of the blend drop 34. The deflector 48 has left and right sides 49 and 50, respectively, which preferably are arranged at equal but opposite angles to the path 41 of the falling blend drop 34. The top edges of the sides 49 and 50 join at a sharp apex 51. The deflector side 50 also has a sharp lower edge 52.

Figures 11, 12, 13, 14, 15, 16, 17, 18:
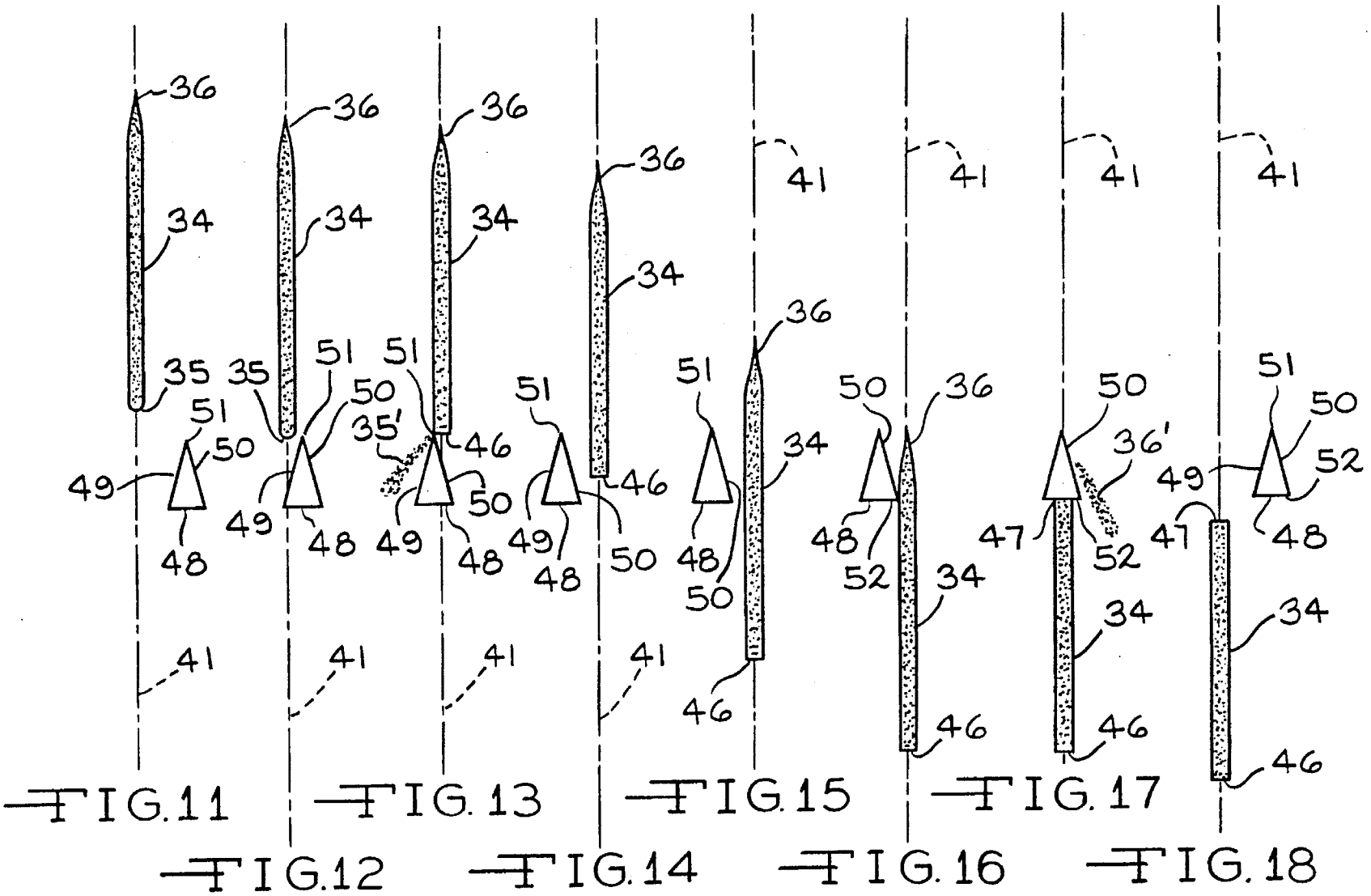
FIG. 11 is a diagrammatic side elevational view showing a granule deflector for trimming the leading and trailing edges of a falling blend drop according to a second embodiment of the invention.
FIG. 12 is a diagrammatic side elevational view and showing a deflector moving to intercept the leading and trailing edges of a falling blend drop.
FIG. 13 is a diagrammatic side elevational view, similar to FIG. 12, and showing the deflector trimming the leading edge of the blend drop.
FIG. 14 is a diagrammatic side elevational view, similar to FIG. 12, and showing the deflector advancing farther to clear the path of the falling blend drop after trimming of the leading edge of the blend drop.
FIG. 15 is a diagrammatic side elevational view, similar to FIG. 12, and showing the deflector positioned to the side of the falling blend drop after the leading edge was trimmed.
FIG. 16 is a diagrammatic side elevational view, similar to FIG. 12, and showing the deflector moving to intercept the trailing edge of the falling blend drop.
FIG. 17 is a diagrammatic side elevational view, similar to FIG. 12, and showing the deflector trimming the trailing edge of the falling blend drop.
FIG. 18 is a diagrammatic side elevational view, similar to FIG. 12, and showing the deflector advancing to a final position clear of the path of the falling blend drop after completion of trimming of the trailing edge.
Figure 19:
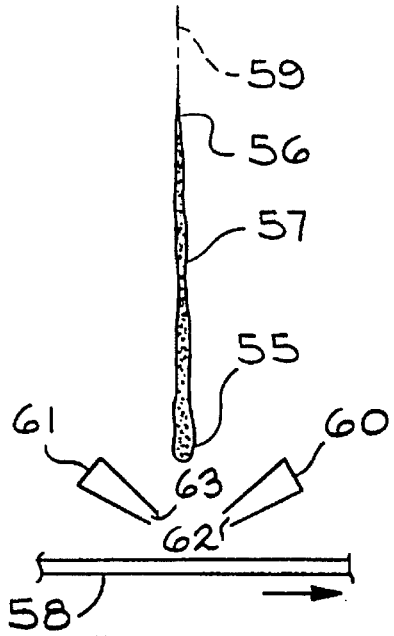
FIG. 19 is a fragmentary diagrammatic side elevational view showing pneumatic deflectors for trimming the leading and trailing edges of a falling blend drop according to a third embodiment of the invention.

Assuming that the deflector 48 is used to trim the leading and trailing edges 35 and 36 of the blend drop 34 as it falls onto a tacky strip moving from left to right, the deflector 48 is initially positioned to the right of the blend drop path 41, as shown in FIG. 11. As the blend drop 34 falls and the leading edge 35 advances next to the side 49, the deflector 48 begins moving to the left, as shown in FIG. 12, and continues to the left until the apex 51 cuts or trims the leading edge 35, as shown in FIG. 13, to form the sharp leading edge 46. The deflector side 49 deflects the trimmed end 35' away from the path 41 where it can be collected and returned to the hopper for recycling. The deflector continues to move to the left clear of the path 41 with sufficient speed that the sharp leading edge 46 of the blend drop 34 does not contact the deflector side 50, as shown in FIG. 14.

The deflector 48 remains in the position to the left of the path 41 as the blend drop continues to fall, as shown in FIG. 15. As the trailing edge 36 approaches the deflector 48, the deflector 48 begins to move to the right, as shown in FIG. 16. At an appropriate time, the deflector 48 is moved so that the sharp lower edge 52 of the side 50 cuts off the irregular trailing edge 36, leaving a sharp trailing edge 47, as shown in FIG. 17. The trimmed end 36' is deflected to the right by the angled side 50 and is collected for recycling. The deflector 48 continues to move to the right until it is clear of the path 41, as shown in FIG. 18, while the trimmed blend drop 34 is deposited onto the moving tacky strip.

Since the tacky strip is moving from left to right and the deflector 48 is moved from right to left for trimming the leading edge 35, any splashed granules which escape collection will fall onto the first area covered by the blend drop. Further, since the trailing edge 36 is trimmed by moving the deflector 48 from left to right, or in the same direction as the tacky strip is moving, any trailing edge granules which escape collection will be sprayed or deflected in a forward direction and will fall onto the blend drop on the moving strip. It should be noted that by placing the deflector 48 close to the moving strip, it may be possible to deflect all of the leading edge granule trimmings 35' and all of the trailing edge granule trimmings 36' onto the first area of the strip covered by the blend drop. In this case, the trimmings are excessive and will not stick to the strip since the tacky surface in the first area is covered by the blend drop 34. These granules may be collected as backfall granules and recycled in a conventional manner.

FIGS. 19 through 23 illustrate still a third embodiment of the invention in which leading and trailing edges 55 and 56 of a blend drop 57 are pneumatically trimmed using air jets. The blend drop 57 is deposited onto a tacky asphaltic strip 58 which is illustrated as moving from left to right. The blend drop 57 falls from a hopper (not shown) along a vertical path 59 to the strip 58. Two manifolds 60 and 61 are positioned on opposite sides of the path 59 adjacent the strip 58. The manifold 60 has a gas discharge slot 62 which extends at least for the full depth of the blend drop 57 and is directed downwardly and to the left, angling toward the strip 58. The manifold 61 has a gas discharge slot 63 which also extends at least for the full depth of the blend drop 57 and is directed downwardly and to the right, angling toward the strip 58. A suitable controller (not shown) may be used to selectively deliver compressed air or other pressurized gas to the manifolds 60 and 61 for discharging gas jets from the slots 62 and 63, respectively, for trimming the leading edge 55 and the trailing edge 56 of the blend drop 57.

Figure 20:
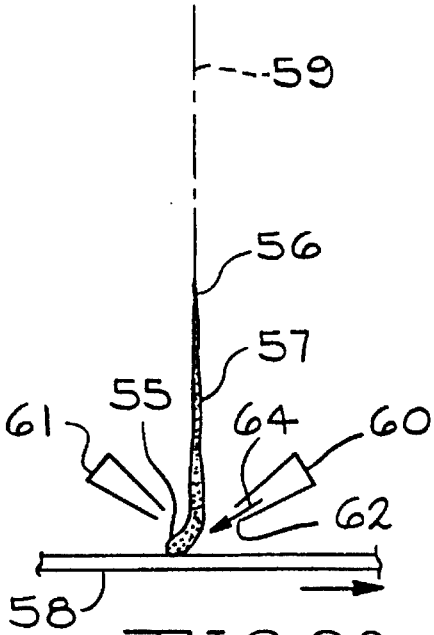
FIG. 20 is a fragmentary diagrammatic side elevational view, similar to FIG. 19, and showing the leading edge of a blend drop being deflected.

Referring to FIG. 20, as the leading edge 55 of the blend drop 57 approaches the moving strip 58, compressed air or other pressurized gas is applied to the manifold 60 to cause a gas jet 64 to be discharged from the slot 62. The gas jet 64 bends the leading edge 55 to the left to cause it to be deposited on the moving strip 58 farther to the left than it would otherwise be deposited. When the gas flow to the manifold 60 is cut off, the blend drop 57 falls along the path 59 to form a sharp leading edge 65 to the blend drop on the moving strip 58. Immediately behind the sharp leading edge 65, the deposited granules will form a thicker area 66 because they will include both the granules which fell along the path 59 and those deflected from the path by the jet 64.

Figure 21:
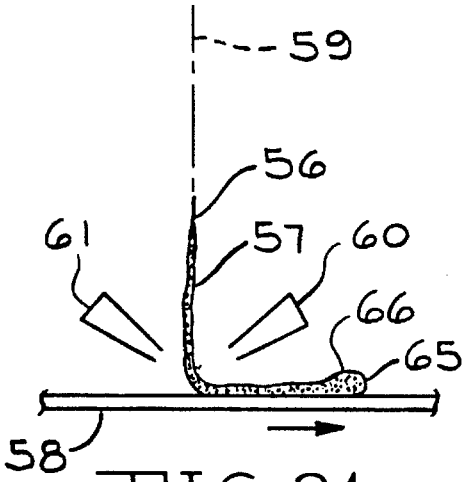
FIG. 21 is a fragmentary diagrammatic side elevational view, similar to FIG. 19, and showing the center of the blend drop being deposited on the moving tacky strip.
Figure 22:
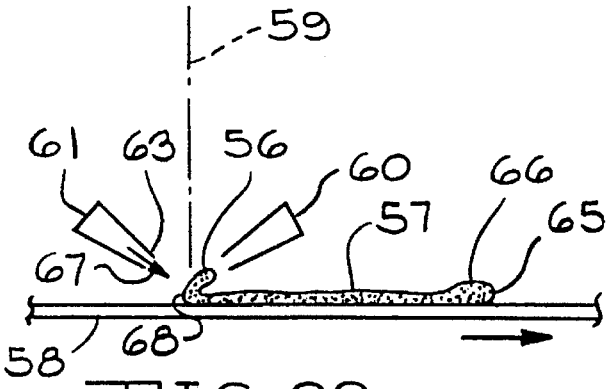
FIG. 22 is a fragmentary diagrammatic side elevational view, similar to FIG. 19, and showing the trailing edge of the blend drop being deflected.
Figure 23:
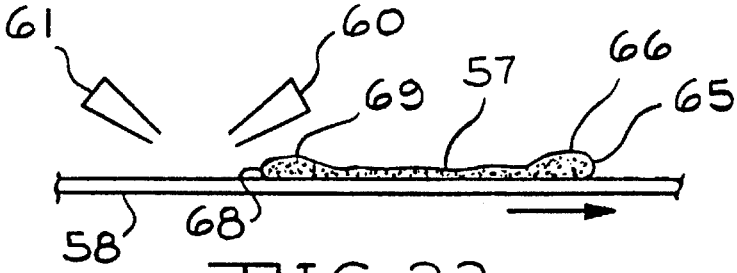
FIG. 23 is a fragmentary diagrammatic side elevational view, similar to FIG. 19, and showing the trimmed blend drop deposited on the moving tacky strip.

The gas flow to the manifolds 60 and 61 remains off and the blend drop 57 continues to fall to the strip 58, as shown in FIG. 21. As the trailing edge 56 approaches the moving strip 58, compressed air or other pressurized gas is applied to the manifold 61 to cause a gas jet 67 to issue from the slot 63. The gas jet 67 deflects the trailing edge 56 to the right, as shown in FIG. 22, where it falls onto the previously deposited granules. This creates a sharp trailing edge 68 on the deposited blend drop 57. The deposited granules will form a thicker area 69 immediately ahead of the sharp trailing edge 68, as shown in FIG. 23. Although the thickness of the deposited granules in the blend drop 57 on the strip 58 will vary and will be thicker at the leading and trailing end areas 66 and 69, it will be appreciated that only the granules which actually contact the tacky surface of the strip 58 will adhere to the strip 58. The remaining granules which are not adhered to the strip 58 are backfall granules which will be removed. After the backfall granules are removed, the blend drop 57 will have a substantially uniform thickness.

It will be appreciated that the above described methods and apparatus of the invention may be readily modified to provide any desired number of different surface areas for receiving different colors and blends of granules to provide a desired surface appearance. It also will be appreciated that although the illustrated drawings show the colored granules being applied across the entire width of the tacky strip, they may be applied only on the portion of the strip which forms the visible portion of the finished shingle. Separate hoppers may be provided for applying low-cost headlap granules to the edge of the strip which becomes the non-visible portion of the finished shingles, as is known in the art. Further, it will be apparent that a number of granule hoppers may be provided for simultaneously forming two or more side-by-side variegated shingles on the moving strip. The individual shingles are cut apart after the granule-coated sheet is cooled.

It will be evident from the foregoing that various modifications can be made to this invention. Such, however, are considered as being within the scope of the invention.

INDUSTRIAL APPLICABILITY

The invention can be useful in the continuous production of variegated granule-coated asphaltic roofing shingles for use in residential and commercial roofing applications.

What is claimed is:

1. A method for forming a variegated granule-covered roofing material comprising periodically dropping a blend drop of granules of a first color onto a tacky surface of a continuously moving sheet of asphaltic material to form spaced granule covered first areas separated by tacky second areas, said first areas having leading and trailing edges in the direction of the sheet movement;

trimming at least one of a leading and a trailing edge of each blend drop of first granules as each drop falls to the moving sheet to provide depositions having sharp edge configurations corresponding to the trimmed edges of granules on each first area; and subsequently dropping a blend drop of a second color onto said tacky second areas of said moving sheet.

2. The method of claim 1 in which said at least one of said leading and trailing portions is trimmed by moving a granule catcher through said blend drop as it falls to the moving sheet.

3. The method of claim 2, wherein said first granules fall along a predetermined path to said sheet, wherein said granule catcher is a leading edge granule catcher, and wherein said leading edge is trimmed by positioning said granule catcher in said path to intercept the leading edge of a drop of first granules, and moving said catcher clear of said path to trim said leading edge.

4. The method of claim 3, and wherein said leading edge granule catcher is moved in a direction opposite the direction of said sheet movement when trimming said leading edge to deflect any granules onto said first area.

5. The method of claim 3, and wherein said trailing edge also is trimmed by moving a trailing edge granule catcher across said path to intercept the trailing edge of a drop of first granules.

6. The method of claim 5, wherein said leading edge granule catcher is moved in a direction opposite the direction of said sheet movement when trimming the leading edge of a drop of first granules, and wherein said trailing edge granule catcher is moved in the direction of said sheet movement when trimming the trailing edge of a drop of first granules.

7. The method of claim 1, and wherein said at least one of said leading and trailing edges are trimmed by deflecting granules from at least one of the leading and trailing edges.

8. The method of claim 7, and wherein said leading edge is trimmed by deflecting granules in a direction substantially opposite the direction of said sheet movement and wherein said trailing edge is trimmed by deflecting granules in substantially the direction of said sheet movement.

9. The method of claim 8, and wherein the first granules are periodically dropped from a first granule hopper, and wherein at least some of the granules trimmed from at least one of the leading and trailing edges of a drop of first granules are returned to said first granule hopper.

10. The method of claim 8, and wherein granules in said leading and trailing edges are deflected by pressurized from at least one gas jet.

11. The method of claim 7, and wherein granules in said at least one of said leading and trailing edges are deflected by pressurized gas from at least one gas jet.

12. The method of claim 1, wherein the desired edge configuration of said second areas is formed as a substantially straight line extending perpendicular to the direction of movement of said moving sheet.

13. The method of claim 1 and further including the step of collecting backfall granules which do not adhere to said first and second areas, and wherein said granules of said first color include said backfall granules.

14. An apparatus for forming a variegated granule-covered roofing material comprising means for moving a tacky sheet of asphaltic material, first hopper means for periodically dropping granules of a first color which are deposited onto first areas of the moving tacky sheet to form first granule covered areas separated by tacky second areas and wherein at least one of a leading edge and a trailing edge of each drop of granules is irregular, means for trimming granules in an irregular at least one of a leading edge and trailing edge of a drop of granules to form a sharp edge to the deposited granules, and second hopper means for depositing granules of a second color on said second areas.

15. The apparatus for forming a variegated granule-covered roofing material of claim 14, and wherein said means for trimming granules comprises a granule catcher movable between a position clear of a path of a drop of granules falling from said hopper to said tacky strip and a position blocking the path of the path of falling granules.

16. The apparatus for forming a variegated granule-covered roofing material of claim 14, and wherein said means for trimming granules comprises a granule deflector.

17. The apparatus for forming a variegated granule-covered roofing material of claim 14, and wherein said granule deflector is a gas manifold from which a compressed gas jet is discharged.

* * * * *

UNITED STATES PATENT AND TRADEMARK OFFICE

CERTIFICATE OF CORRECTION

PATENT NO. : 5,547,707

DATED : August 20, 1996

INVENTOR(S) : Thomas D. Haubert, James S. Belt

It is certified that error appears in the above-identified patent and that said Letters Patent is hereby corrected as shown below:

Column 10, Claim 10, Line 2, after "pressurized", insert --gas--.

Signed and Sealed this

Twenty-sixth Day of November 1996

*Attest:*

Bruce Lehman

BRUCE LEHMAN

*Attesting Officer*

*Commissioner of Patents and Trademarks*